US006305817B1

(12) United States Patent
Johnston et al.

(10) Patent No.: US 6,305,817 B1
(45) Date of Patent: Oct. 23, 2001

(54) ILLUMINATED CONTAINER HOLDER

(76) Inventors: Kent E. Johnston, 883 Emmons, Eirmingham, MI (US) 48009; Aakash C. Chopra, 6 Craigie Cir. Apt. 34, Cambridge, MA (US) 02138

( * ) Notice: Subject to any disclaimer, the term of this patent is extended or adjusted under 35 U.S.C. 154(b) by 0 days.

(21) Appl. No.: 09/105,800

(22) Filed: Jun. 1, 1998

Related U.S. Application Data

(60) Provisional application No. 60/054,714, filed on Jun. 12, 1997.

(51) Int. Cl.[7] ..... F21V 33/00

(52) U.S. Cl. ..... 362/154; 362/84; 362/101; 362/194; 362/800

(58) Field of Search ..... 362/84, 101, 194, 362/800, 154

(56) References Cited

U.S. PATENT DOCUMENTS

| | | | | |
|---|---|---|---|---|
| 4,086,733 | * | 5/1978 | Strawick | 46/74 |
| 4,556,932 | * | 12/1985 | Lehrer et al. | 362/103 |
| 4,771,911 | * | 9/1988 | Morony et al. | 220/408 |
| 5,119,279 | * | 6/1992 | Makowsky | 362/101 |
| 5,211,699 | * | 5/1993 | Tipton | 362/101 |
| 5,785,407 | * | 7/1998 | Ratcliffe et al. | 362/101 |
| 5,856,031 | * | 1/1999 | Burrows | 428/690 |

* cited by examiner

*Primary Examiner*—Sandra O'Shea
*Assistant Examiner*—John Anthony Ward
(74) *Attorney, Agent, or Firm*—Owen E. Perry

(57) ABSTRACT

A holder for a container (of beverage, for example) having a compartment, at least partly of light transmitting material to permit light to be transmitted to and from the compartment. The housing has a central axis that is vertical when the housing is upright, and a wall that encloses the axis and forms the outer side wall of the compartment. A cover is supported on the upper edge of the side wall and overlies the compartment. The cover includes a support and holding device in which a container can be received and removed by relative axial movement between the container and holder, and which is operable to support upright a container received therein upright on the side of the cover opposite the compartment, and to restrain the container against separation from the holder with a restraining force that will cause the container and holder to move as a unit when lifting force is applied only to the container, but which restraining force can be selectively overcome by pulling the container and holder apart from each other.

A light-emitter in the form of an EL lamp comprising a laminate including ZnS phosphor particles may be received in the compartment with a circuit that is responsive to a pre-selected condition (e.g., the upright position of the holder) to activate the EL lamp, and to deactivate it in the absence of the pre-selected condition.

25 Claims, 3 Drawing Sheets

ILLUMINATED CONTAINER HOLDER

CLAIM OF PRIORITY UNDER 35 U.S.C. 119 (e)

Applicants claim priority of their provisional application No. 60/054,714 filed Jun. 12, 1997, the entire disclosure of which is incorporated herein by reference.

BACKGROUND OF THE INVENTION

1. Field of the Invention

This invention relates to holders for containers—particularly beverage containers—which include self-contained illumination systems for displaying messages, designs, detecting conditions of the container or holder, etc.

2. Description of the Prior Art

Representative prior art U.S. patents in the relevant art include U.S. Pat. No. 4,886,183 (Keith A. Fleming) issued Dec. 12, 1989; U.S. Pat. No. 49,922,355 (Dietz and Silver) issued May 1, 1990; U.S. Pat. No. 5,211,699 (Tipton) issued May 18, 1993; U.S. Pat. No. 5,307,250 (Pearson) issued Apr. 26, 1994; and U.S. Pat. No. 5,504,663 (Tucker) issued Apr. 2, 1996.

SUMMARY OF THE INVENTION

A holder for a container of a beverage (or other substance) according to the present invention includes a housing that encloses a compartment. The housing is, at least in part, of light transmitting material (preferably transparent) so that light can be transmitted to and from the compartment through the light-transmitting material. As used in this specification, the term "light-transmitting" is generic to "transparent" and "translucent".

A container can be detachably secured to the holder by a container-gripping means on the body of the holder, externally of the compartment, in such a manner that the holder will remain attached (such as by friction) to the container when it is lifted by the user, but can be separated, when desired, with relative ease by overcoming the friction.

A light emitter, is received in the compartment that can be selectively activated and deactivated to emit, and not emit, light from the compartment through the light transmitting material.

The light emitter is activated and deactivated by a light emission circuit that is also housed within the compartment, and is responsive to a pre-selected condition, e.g., when the holder is in an upright position, to activate the light emitter, and is responsive to the absence of the pre-selected condition to deactivate the light emitter; i.e., when the holder is on its side or upside down, the light is off.

DESCRIPTION OF THE PREFERRED EMBODIMENT(S)

A holder according to the present invention includes a housing enclosing a compartment for a light emitter (or source) and related electrical circuitry and components, and container-gripping means for detachably securing the holder to a container; usually a beverage container, although it is apparent that the invention is not dependent for its function on the particular contents of any container with which the holder is used.

Figure 1:
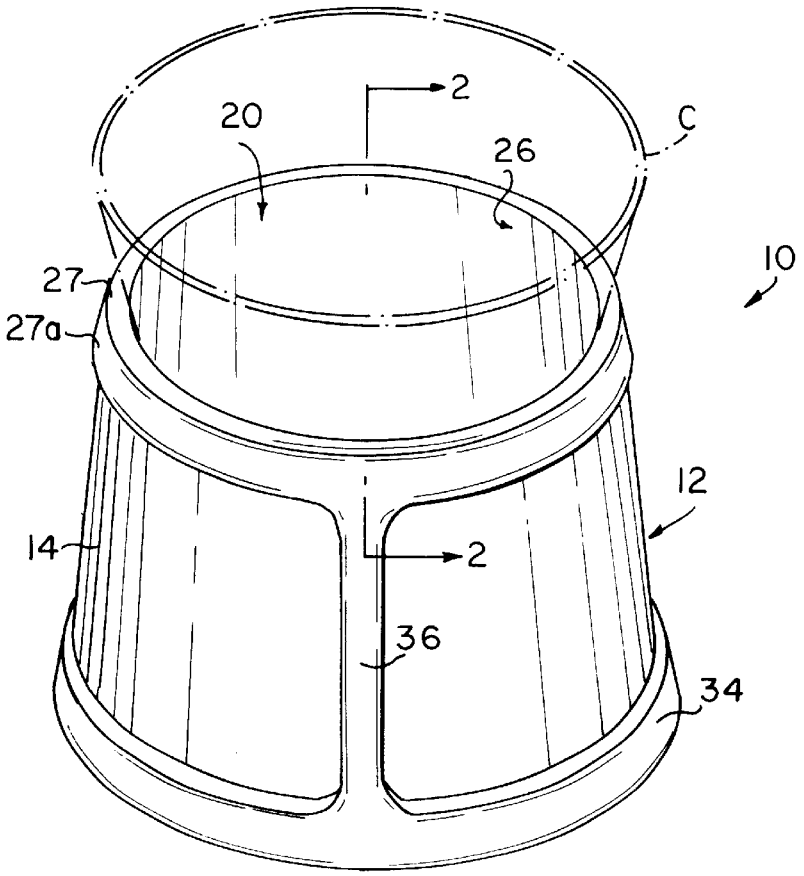
FIG. 1 is a perspective view of a holder for a container of beverage, or the like, embodying the invention.
Figure 2:
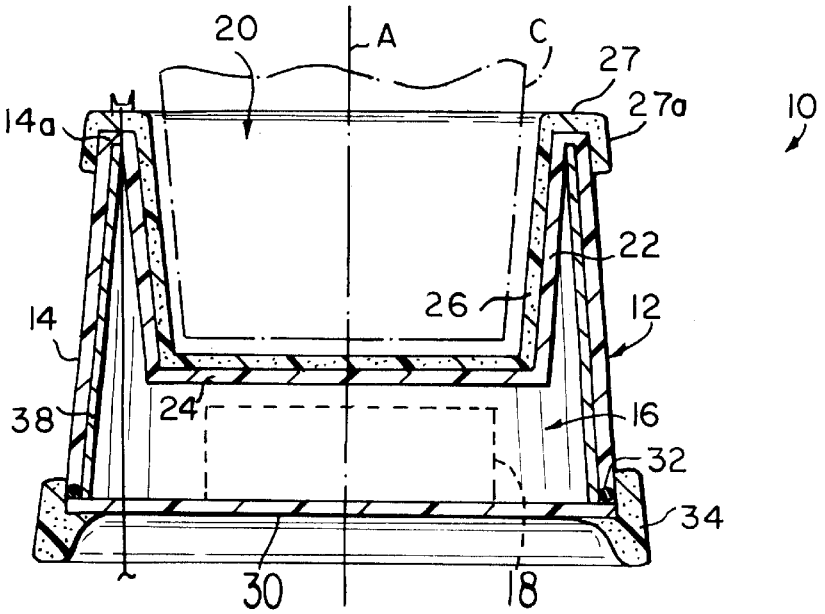
FIG. 2 is a sectional taken along line 2—2 of FIG. 1.

As shown in FIGS. 1 and 2, reference numeral 10 collectively designates a holder in which is received a container C shown in phantom lines.

The holder 10 includes a housing 12 having an axis A (FIG. 2) and an endless wall 14 that encloses a compartment 16 for the components of a light emission circuit 18 as discussed further below. The term "endless" means that wall 14 encloses a space, but is not required to have the particular circular cross-sectional configuration transverse to axis A, as shown in the preferred embodiment of FIGS. 1 in order to perform its function.

The container-gripping means is designated collectively by reference numeral 20 in FIGS. 1 and 2. The function of the container-gripping means 20 is to detachably secure the container C to the holder 10 in such a manner that it will not separate from the container when the container is lifted or otherwise moved from a supporting table or counter-top during use. However, the holder and container can be selectively separated from each other with relative ease when the container is empty or no longer in use, and needs to be replaced. In the illustrated embodiment, this function is carried out by employing friction, or suction, or a combination thereof.

The container-gripping means 20 includes a recess formed in the housing 12 by an endless side wall 22 (FIG. 2) that extends from the upper edge 14*a* of the side wall 14 of the housing 12 to a flat end wall 24. A liner 26 of resilient compressible material, such as rubber, foamed cellular material, or the like, covers the surfaces of the side and end walls 22,24 of the recess 20. The liner 26 may be secured in the recess by an adhesive, or by an interference fit.

When a container C of a configuration complementary to the liner 26 in placed into the recess 20, its size is such that it compresses and frictionally engages the material of the liner 26. When the container is lifted, the combination of suction and frictional forces prevents separation of the holder 10 and container C, and the holder 10 is carried by the container. The holder and container thus move as a unit until the are selectively forced apart against the frictional forces and suction that resist separation.

The shape of the liner 26 is complementary to that of the recess 20 in the illustrated embodiment so as to cover the entire surface of the recess. It also includes an outwardly projection flange 27 with an outer downwardly projecting flange 27*a* to cover the upper edge portions of the recess 20 and side wall 14.

Figure 2A:
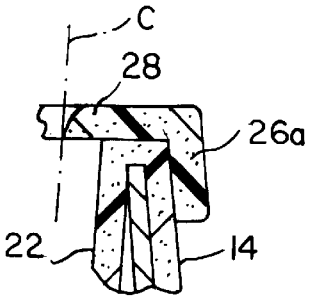
FIG. 2A is fragmentary cross sectional view of a modification of FIG. 2.
Figure 3:
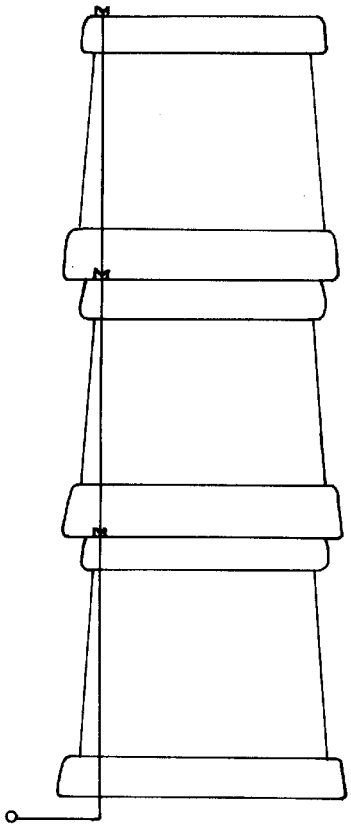
FIG. 3 is an elevational view illustrating three of the holders of FIGS. 1 and 2 in stacked relation for storage or simultaneous recharging.

FIG. 2A illustrates an alternative to the use of a liner 26 that covers the entire liner surface of the recess 20. Instead of the cup-shaped liner 26 of FIG. 2, a resilient grommet 26*a* is mounted on the upper edge of the housing 14. The grommet 26*a* is formed with a lip 28 that projects radially inwardly of side wall 22 and encircles the opening to recess 20. The side wall of a container C, such as a beer can, engages the resilient lip 28 with an interference fit which detachably secures the container to the holder.

As another alternative, the material of the housing 12 can be selected to provide sufficient flexibility of the side wall 22 to coact in a force fit relationship with a container to frictionally secure the container to the holder 10.

The holder 10 has a removable bottom wall 30 which serves as an access panel to the compartment 16. An O-ring 32, (FIG. 2) provides a watertight seal for compartment 16.

In the illustrated embodiment, a resilient molding strip 34 encircles the lower edge of the wall 14 of housing 12 and the edge of the access panel 30 to provide additional sealing of the compartment 16 and to serve as a resilient, anti-skid support for the holder 10.

In the illustrated embodiment, the molding strip 34 is joined to the liner 26 by vertical connecting strips 36 extending between flange 27*a* and the molding strip as shown in FIG. 1, so that the liner 26, vertical strips 36, and molding strip 34 are of a single-piece construction.

The side wall 14 of housing 12, and the side and end walls 22 and 24 of recess 20 are of one-piece construction with the side walls 14 and 22 concentric to each other with respect to axis A. In the embodiment illustrated in FIGS. 1 and 2, the cross-sectional diameter of the side wall 14 transverse to axis A increases progressively from its upper edge covered by the liner flange 27 to its lower edge adjacent to the access panel 30. Conversely, the cross-sectional diameter of the side wall 22 of the recess 20 decreases progressively from its connection with the upper edge of the housing side wall 14 to the end wall 24 of the recess.

The material for the housing 12 is preferably semi-rigid to rigid polymeric materials, and is transparent, although there may be applications in which it would be desirable that the light transmitting capabilities of the housing material be less than completely transparent to achieve effects better obtainable by translucent properties.

Reference numeral 38 (FIG. 2) designates a panel of a light source or emitter sized to fit against the inside surface of the side wall 14 of housing 12. The light emitter 38 may be an electroluminescent (EL) lamp composed of ZnS phospher particles in a laminate suitable for applying current. One type of EL lamp is the Durel R 3EL lamp manufactured by the Durel Corporation of Chandler, Ariz. A direct current (DC) power source is employed much as an AA dry cell battery; a nickel-cadmium, nickel metal hydride, or a lithium-ion battery capable of being recharged.

Another suitable light emitter is disclosed in the brochure entitled LUMITEX R Solid State Backlighting, copyright 1996, of Lumitex, Inc. of Strongsville, Ohio. The Lumitex brochure also states that "Lumitex Solid State is covered by U.S. Pat. Nos. 5,005,100 and 5,138,480 and other patents pending." The Lumitex brochure discloses a system that uses LED panels for backlighting LCD modules.

Figure 4:
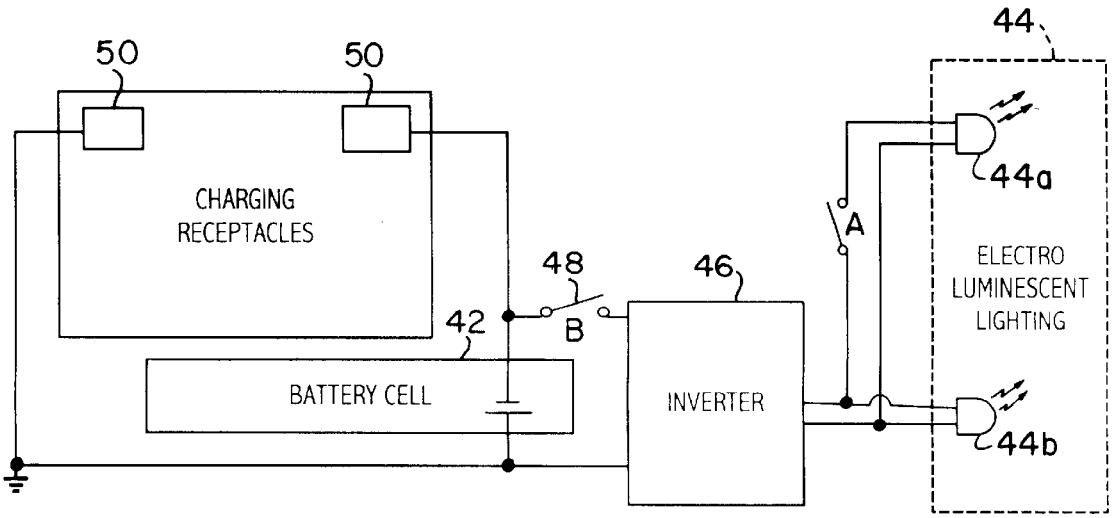
FIG. 4 is a diagram of a light emission circuit having duel light emitters suitable for installation in the holder of FIGS. 1 and 2.

FIG. 4 is a diagram of a light emission circuit utilizing a pair of EL lamps, each of which may form portions of panel 38 seated against the inner surface of side wall 14 of housing 12 (FIG. 2 ). The dual EL light emission circuit of FIG. 4 includes a power source 42 in the form of a battery. The battery 42 is connected to a light emitter 44 including two EL lamps 44*a* and 44*b*.

Reference numeral 46 designates an inverter for converting the direct current (DC) from the battery 42 to alternating current (AC) for energizing the EL light emitter 44. A switch 48 is moveable from the open position shown in FIG. 4 to a closed position to energize the EL light emitter 44 causing it to illuminate and emit light from compartment 16 through the light transmitting material of side wall 14.

According to the present invention, the switch 48 is closed when the holder 10 is in the upright position shown in FIG. 2, and is in the open position shown in FIG. 4 when the holder 10 is not in the upright position; when the holder 10 is on its side, or upside down instead of the upright position of FIG. 2, the light emitter 44 is off and not illuminated and hence does not emit light from compartment 16. Conversely, when the holder 10 is in the upright position, the switch 48 is always closed and the compartment 16 is illuminated.

The switch 48 may be a mercury switch that moves between the open and closed positions in response to movement of the holder 10 from a non-upright to upright position.

Reference numeral 50 designates a charging receptacle for recharging battery 42 in FIG. 4.

Figure 5:
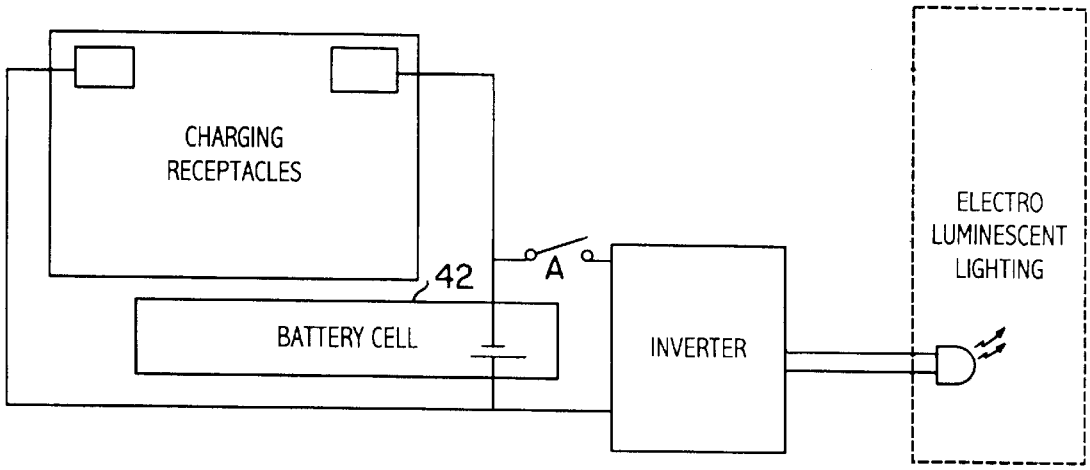
FIG. 5 is a diagram of a light emission circuit having a single light emitter circuit for the holder.

FIG. 5 is also an EL light emission circuit in which the light emitter is a single EL lamp. It is otherwise not materially different from FIG. 4.

The access panel 30 may be of different material than the housing 14, and does not require light transmitting properties.

Several light emitters 44 may be used in conjunction with a switching device (not shown) may be used with a single light emitter 38 to alternate it between the energized and de-energized states.

Advertisement, lettering, logos or other decorative matter may be printed on the exterior surface of the housing 12 on the side wall 14 which becomes accented when the light emitter 38 is illuminated. Alternatively, matter may be inscribed or impressed upon the interior or exterior surfaces of the side wall 14 of the housing 12 to accomplish a similar effect.

The container holder 10 may also be equipped with charging receptacles 50 to facilitate recharging of the power source 42 while keeping the holder 10 intact. The charging receptacles 50 are connected in parallel and terminate in a pair of contact pads 50*a*, 50*b* on the lower portion 18 or access panel 34 of the housing 12. The holder 10 can then be placed on a charging base (not shown) to recharge the power source 42. For applications where it is desired that more than one holder be charged at a time, the holder may further include an addition pair of contact pads 56 on the upper portion 16. Thus, the holders may be stacked one on top of another on the charging base.

To aid in the alignment of the contact pads, when the holders are stacked, the contact pads may be paired concentric annular rings. Thus, the holders may be oriented radially in any position and still be in contact with the contact pads of another holder. Alternatively, the holders may incorporate a radial positioning structure such as a notch and tab on the perimeter of the holder to ensure alignment of the contact pads with another stacked holder.

While specific embodiments of the invention are illustrated in the drawings and described in the specification, the invention is not limited to the exact construction shown and described. Variations in the construction and arrangements of parts and components are possible without departing from the scope of the invention as defined in the claims.

What is claimed is:

1. A holder for a container comprising a housing having an endless wall enclosing a compartment, at least a portion of said housing being of light transmitting material to permit light to be transmitted to and from said compartment; container-gripping means on said housing for detachably securing a container to said housing externally of said compartment in such a manner that the holder will remain attached to the container during use until it is selectively detached by the user; a light emitter in said compartment having an active condition in which it emits light from said compartment through said light transmitting material and an inactive condition in which it does not emit light, and a light emission circuit in said compartment operable in response to a pre-selected condition to activate said light emitter, and in response to the absence of said pre-selected condition to deactivate said light-emitter; said pre-selected condition existing only when said housing is in an upright position.

2. A holder for a container comprising a housing having an endless wall enclosing a compartment, at least a portion of said housing being of light transmitting material to permit light to be transmitted to and from said compartment; and container-gripping means on said housing for detachably securing a container to said housing externally of said compartment in such a manner that the holder will remain attached to the container during use until it is selective detached by the user; said container-gripping means comprising a container-receiving recess formed in said housing, said recess having an endless side wall of circular cross-section for receiving a container and detachably securing the container by friction to said housing; and said endless side wall of said recess being tapered such that its cross-sectional diameter decreases progressively from one end to the other.

3. A holder for a container comprising a housing having an endless wall enclosing a compartment, at least a portion of said housing being of light transmitting material to permit light to be transmitted to and from said compartment; container-gripping means on said housing for detachably securing a container to said housing externally of said compartment in such a manner that the holder will remain attached to the container during use until it is selectively detached by the user; a light emitter in said compartment having an active condition in which it emits light from said compartment through said light transmitting material, and an inactive condition in which it does not emit light; a light emission circuit in said compartment operable in response to a pre-selected condition to activate said light emitter, and in response to the absence of said preselected condition to deactivate said light-emitter; said housing including an endless housing side wall of light transmitting material enclosing said compartment, and said light emitter comprising an EL lamp; said EL lamp comprising a laminate including ZnS Phosphor particles that fits against at least a portion of the inner surface of the side wall of said housing.

4. A holder for a container comprising a housing having an endless wall enclosing a compartment, at least a portion of said housing being of light transmitting material to permit light to be transmitted to and from said compartment; container-gripping means on said housing for detachably securing a container to said housing externally of said compartment in such a manner that the holder will remain attached to the container during use until it is selectively detached by the user; a light emitter in said compartment having an active condition in which it emits light from said compartment through said light transmitting material, and an inactive condition in which it does not emit light; a light emission circuit in said compartment operable in response to a pre-selected condition to activate said light emitter, and in response to the absence of said pre-selected condition to deactivate said light-emitter; said light emitter comprising an LED panel; and an LCD display panel in said compartment, and wherein said LED panel is disposed to back light said LCD panel.

5. A holder for a container, said holder comprising:

A housing with a compartment formed therein; at least a portion of said housing being of light transmitting material to permit light to be transmitted to and from said compartment, said housing including:

An axis (A) that is vertical when the housing is upright;

An endless wall that encloses said axis and forms the outer side wall of the compartment; said outer side wall having opposite ends that define the upper and lower edges of the side wall in the upright position of the housing; a cover supported on the upper edge of said side wall and overlying said compartment; a support and holding device on said cover in which a container can be received and removed by relative axial movement between the container and holder; said support and holding device being operable to support said container received therein upright on the side of the cover opposite said compartment, and to restrain the container against separation from the holder with a restraining force that will cause the container and holder to move as a unit when a lifting force is applied only to the container, but which restraining force can be selectively overcome to cause the container to separate from the holder by pulling the container and holder apart from each other.

6. A holder as claimed in claim 5 further including a light emitter in said compartment having an active condition in which it emits light from said compartment through said light transmitting material, and an inactive condition in which it does not emit light.

7. A holder as claimed in claim 6 in which said light emitter comprises an LED panel.

8. A holder as claimed in claim 7 further including an LCD display panel in said compartment, and wherein said LED panel is disposed to back light said LCD panel.

9. A holder as claimed in claim 6 further including a light emission circuit in said compartment operable in response to a pre-selected condition to activate said light emitter, and in response to the absence of said pre-selected condition to deactivate said light-emitter.

10. A holder as claimed in claim 6 in which said light transmitting material is transparent.

11. A holder as claimed in claim 8 in which said light emitter comprises at least one EL lamp.

12. A holder as claimed in claim 8 in which said pre-selected condition exists only when said housing is in an upright position.

13. A holder as claimed in claim 5 wherein said upper and lower edges of said outer side wall each lies in a plane transverse to said axis A.

14. A holder as claimed in claim 13 wherein the area enclosed by said lower edge is larger than the area enclosed by said upper edge.

15. A holder as claimed in claim 14 wherein said outer side wall has a non-rectilinear cross-section.

16. A holder as claimed in claim 15 wherein said outer side wall has a circular cross-section.

17. A holder as claimed in claim 16 wherein said outer side wall has a diameter that progressively increases from said upper edge to said lower edge.

18. A holder as claimed in claim 5 wherein said support and holding device includes a recess on the side of said cover opposite said compartment, in which recess a container can be inserted and removed by relative axial movement between the container and holder.

19. A holder as claimed in claim 18 wherein said recess has an endless side wall.

20. A holder as claimed in claim 19 in which the EL lamp comprises a laminate including ZnS Phosphor particles that fits against at least a portion of the inner surface of the side wall of said housing.

21. A holder as claimed in claim 6 which said light emitter comprises an EL lamp.

22. A holder as claimed in claim 18 wherein said support and holding device further comprises a resilient grommet mounted on said upper edge, said grommet having an inwardly projecting lip engageable with the side wall of the container to detachably secure the container to said holder.

23. A holder claimed in claim 19 wherein said support and holding device further comprises a liner of resilient compressible material that covers the inner surface of the side wall of said recess.

24. A holder as claimed in claim 23 wherein said recess terminates in a flat end wall that is spaced beneath said upper edge in the upright position and is transverse to said axis A.

25. A holder as claimed in claim 5 further including a container in combination therewith, said container being axially received in said support and holding device and restrained against separation from said holder with restraining force sufficient to cause the container and holder to move as a unit when a lifting force is applied only to said container, but which restraining force can be selectively overcome to cause said container to separate from the holder by pulling said container and holder apart from each other.

* * * * *